US011600425B2

(12) United States Patent
Wada et al.

(10) Patent No.: US 11,600,425 B2
(45) **Date of Patent: *Mar. 7, 2023**

(54) COIL COMPONENT

(71) Applicant: TAIYO YUDEN CO., LTD., Tokyo (JP)

(72) Inventors: Koichiro Wada, Tokyo (JP); Motoki Matsui, Tokyo (JP); Hideki Ogawa, Tokyo (JP); Tomoo Kashiwa, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 219 days.

This patent is subject to a terminal disclaimer.

(21) Appl. No.: 17/135,587

(22) Filed: Dec. 28, 2020

(65) Prior Publication Data

US 2021/0118603 A1 Apr. 22, 2021

Related U.S. Application Data

(63) Continuation of application No. 16/052,830, filed on Aug. 2, 2018, now Pat. No. 10,910,141.

(30) Foreign Application Priority Data

Aug. 9, 2017 (JP) ..... JP2017-154625

(51) Int. Cl.
*H01F 5/00* (2006.01)
*H01F 27/255* (2006.01)
(Continued)

(52) U.S. Cl.
CPC ..... *H01F 27/255* (2013.01); *H01F 1/153* (2013.01); *H01F 1/34* (2013.01); *H01F 17/0013* (2013.01);
(Continued)

(58) Field of Classification Search
CPC ..... H01F 27/2804; H01F 2027/2809; H01F 27/255
(Continued)

(56) References Cited

U.S. PATENT DOCUMENTS

2002/0097124 A1 7/2002 Inoue et al.
2003/0001718 A1 1/2003 Inoue et al.
(Continued)

FOREIGN PATENT DOCUMENTS

JP 07-135106 A 5/1995
JP 2002-305108 A 10/2002
(Continued)

OTHER PUBLICATIONS

Notice of Reasons for Refusal dated Jun. 8, 2021, issued in corresponding Japanese Patent Application No. 2017-154625 with English translation (7 pgs.).
(Continued)

*Primary Examiner* — Ronald Hinson
(74) *Attorney, Agent, or Firm* — Pillsbury Winthrop Shaw Pittman, LLP

(57) ABSTRACT

One object is to increase the filling factor of magnetic particles and increase the evenness of distribution of the magnetic particles in a magnetic main body of a coil component. A coil component includes: a magnetic main body containing a resin and magnetic particles; and a coil conductor embedded in the magnetic main body. The magnetic particles include large-sized magnetic particles, middle-sized magnetic particles, and small-sized magnetic particles. The proportion of the volume of the large-sized magnetic particles to the total volume of all the magnetic particles is 70 vol % to 85 vol %, the proportion of the volume of the middle-sized magnetic particles to the total volume is 2 vol % to 28 vol %, and the proportion of the
(Continued)

volume of the small-sized magnetic particles to the total volume is 2 vol % to 28 vol %. The particle size distribution of the small-sized magnetic particles overlaps that of the middle-sized magnetic particles.

13 Claims, 11 Drawing Sheets

(51) Int. Cl.

| | |
|---|---|
| ***H01F 27/28*** | (2006.01) |
| ***H01F 1/153*** | (2006.01) |
| ***H01F 1/34*** | (2006.01) |
| ***H01F 17/00*** | (2006.01) |
| *H01F 27/29* | (2006.01) |

(52) U.S. Cl.
CPC ..... *H01F 27/2804* (2013.01); *H01F 1/15308* (2013.01); *H01F 27/292* (2013.01); *H01F 2027/2809* (2013.01)

(58) Field of Classification Search
USPC ..... 336/200
See application file for complete search history.

(56) References Cited

U.S. PATENT DOCUMENTS

| | | | |
|---|---|---|---|
| 2004/0207954 | A1 | 10/2004 | Inoue et al. |
| 2004/0209120 | A1 | 10/2004 | Inoue et al. |
| 2014/0009252 | A1 | 1/2014 | Samata et al. |
| 2014/0077914 | A1 | 3/2014 | Ohkubo |
| 2015/0028983 | A1 | 1/2015 | Ryu et al. |
| 2015/0235753 | A1 | 8/2015 | Chatani |
| 2016/0155550 | A1 | 6/2016 | Ohkubo et al. |
| 2016/0314889 | A1 | 10/2016 | Ryu et al. |

FOREIGN PATENT DOCUMENTS

| | | | |
|---|---|---|---|
| JP | 2006-179621 | A | 7/2006 |
| JP | 2007-200962 | A | 8/2007 |
| JP | 2010-034102 | A | 2/2010 |
| JP | 2014-013803 | A | 1/2014 |
| JP | 2014-060284 | A | 4/2014 |
| JP | 2014-204108 | A | 10/2014 |
| JP | 2015-026812 | A | 2/2015 |
| JP | 2016-103598 | A | 6/2016 |
| JP | 2016-208002 | A | 12/2016 |
| JP | 2016-225647 | A | 12/2016 |

OTHER PUBLICATIONS

Decision of Refusal dated Feb. 1, 2022 issued in corresponding Japanese Patent Application No. 2017-154625, with English machine translation (7 pgs.).
English translation 2008127230 (Year: 2008).
Reconsideration Report by Examiner before Appeal dated Jun. 14, 2022, issued in corresponding Japanese Patent Application No. 2017-154625 with English translation (5 pgs.).

COIL COMPONENT

CROSS-REFERENCE TO RELATED APPLICATIONS

This application is a continuation of U.S. patent application Ser. No. 16/052,830 (filed on Aug. 2, 2018), which claims the benefit of priority from Japanese Patent Application Serial No. 2017-154625 (filed on Aug. 9, 2017), the contents of which are hereby incorporated by reference in their entirety.

TECHNICAL FIELD

The present invention relates to a coil component. In particular, the present invention relates to a coil component including a magnetic main body and a coil conductor embedded in the magnetic main body, the magnetic main body being made of a composite resin material containing a resin and magnetic particles.

BACKGROUND

One such coil component is an inductor. An inductor is a passive element used in an electric circuit. For example, an inductor eliminates noise in a power source line or a signal line.

Typically, a coil component includes a magnetic main body, a coil conductor embedded in the magnetic main body, and external electrodes connected to end portions of the coil conductor. In most cases, the magnetic main body of the coil component is formed of ferrite or a composite resin material.

In this composite resin material, a large number of magnetic particles are bound to each other by a binder resin. Composite resin materials, which can be cast into shapes easily as compared to ferrite, are used widely as materials for magnetic bodies of compact coil components.

The magnetic main body made of the composite resin material is produced by injection molding or transfer molding. More specifically, the magnetic main body is formed by mixing magnetic particles and a binder resin to produce a slurry, casting the slurry into a mold, and curing the slurry in the mold.

The magnetic main body of the coil component is desired to have a high magnetic permeability. To increase the magnetic permeability of the magnetic main body made of the composite resin material, the filling factor of the magnetic particles in the magnetic main body should be increased.

There have been proposals of techniques for increasing the filling factor of the magnetic particles so as to increase the magnetic permeability. For example, Japanese Patent Application Publication No. 2006-179621 discloses a composite magnetic material containing first magnetic particles and second magnetic particles. This publication discloses that a molded product having magnetic particles filled therein at a high density can be produced by satisfying the following conditions:

the average particle size of the second magnetic particles is equal to or less than 50% of that of the first magnetic particles, and $0.05 \leq Y/(X+Y) \leq 0.30$, where X is the content (wt %) of the first magnetic particles, and Y is the content (wt %) of the second magnetic particles.

It is also disclosed in Japanese Patent Application Publication No. 2015-026812 that the filling factor of magnetic particles can be increased by satisfying the following conditions:

a magnetic main body contains first magnetic particles and second magnetic particles both made of an amorphous metal containing iron (Fe), the first magnetic particles are constituted by rough grains 15 μm or larger in long axis, and the second magnetic particles are constituted by fine grains 5 μm or smaller in long axis.

Further, Japanese Patent Application Publication No. 2016-208002 discloses that the filling factor of magnetic particles can be increased when a magnetic main body contains magnetic particles having three or more types of particle size distribution.

As described above, the conventional way to increase the filling factor of magnetic particles in a magnetic main body has been to use two or three types of magnetic particles having different sizes in the magnetic main body.

As described above, the magnetic main body is formed by mixing magnetic particles and a binder resin to produce a slurry, casting the slurry into a mold, and curing the slurry in the mold. The viscosity of the slurry is higher when the slurry contains magnetic particles having a small size. Therefore, to produce a magnetic main body containing magnetic particles having a small size, it is necessary to apply a high pressure when placing the slurry into a mold. However, when a high pressure is applied to the slurry being placed into a mold, strains occurring in the magnetic particles may increase the core loss. In contrast, when the applied pressure is insufficient, the magnetic particles are distributed unevenly in the molded magnetic main body.

SUMMARY

An object of the present invention is to solve or relieve at least a part of the above problem. In particular, an object of the present invention is to increase the filling factor of magnetic particles and increase the evenness of distribution of the magnetic particles in a magnetic main body of a coil component. Other objects of the present invention will be apparent with reference to the entire description in this specification.

A coil component according to one embodiment of the present invention comprises: a magnetic main body containing a resin and magnetic particles; and a coil conductor embedded in the magnetic main body, wherein the magnetic particles include first magnetic particles, second magnetic particles, and third magnetic particles.

Among the magnetic particles contained in the magnetic main body, the first magnetic particles have the largest average particle size. When the average particle size of the first magnetic particles is too large, the outer surfaces of the magnetic main body are uneven. Therefore, in one embodiment of the present invention, the average particle size of the first magnetic particles is 50 μm or smaller. The unevenness in the outer surfaces of the magnetic main body causes the external electrodes to fall off. When the average particle size of the first magnetic particles is 50 μm or smaller, the outer surfaces of the magnetic main body are smooth and the external electrodes can be prevented from falling off. When the average particle size of the first magnetic particles is 50 μm or smaller, the outer surfaces of the magnetic main body remain smooth even after the outer surfaces are cut or ground.

Conversely, when the average particle size of the first magnetic particles is too small, the viscosity of a slurry containing the first magnetic particles is high, and therefore, a high pressure is necessary to cast the slurry into a mold in producing the magnetic main body. To prevent the viscosity of the slurry from exceeding a predetermined value, there is provided a lower limit of the average particle size of the first magnetic particles. In one embodiment of the present invention, the average particle size of the first magnetic particles is 15 μm or larger.

In one embodiment of the present invention, the average particle size of the second magnetic particles is smaller than that of the first magnetic particles, and the average particle size of the third magnetic particles is smaller than that of the second magnetic particles. In one embodiment, the average particle size of the second magnetic particles is 2 μm to 10 μm. In one embodiment, the average particle size of the third magnetic particles is less than 2 μm.

Three or more types of particles having different average particle sizes as described above can be mixed together to increase the filling factor of the magnetic particles in the magnetic main body.

In one embodiment of the present invention, the average particle size of the third magnetic particles is 0.5 μm or smaller. Thus, even when the coil component is excited at a high frequency, it can be prevented that an eddy current occurs in the third magnetic particles. This improves the high frequency characteristics of the coil component.

In one embodiment of the present invention, the filling factor of the magnetic particles in the magnetic main body is 87% or higher. This increases the magnetic permeability of the magnetic main body.

The content of the magnetic particles is determined as described below. When the contents of the second magnetic particles and the third magnetic particles are high, the viscosity of a slurry containing the second magnetic particles and the third magnetic particles is high, and therefore, a high pressure is necessary to cast the slurry into a mold in producing the magnetic main body. Conversely, when the contents of the second magnetic particles and the third magnetic particles are low, the filling factor of the magnetic particles in the magnetic main body is low. Therefore, it is necessary to provide an upper limit and a lower limit of the contents of the second magnetic particles and the third magnetic particles. In one embodiment of the present invention, the proportion of the volume of the first magnetic particles to the total volume of the first magnetic particles, the second magnetic particles, and the third magnetic particles is 70 vol % to 85 vol %, the proportion of the volume of the second magnetic particles to the total volume is 2 vol % to 28 vol %, and the proportion of the volume of the third magnetic particles to the total volume is 2 vol % to 28 vol %. When the contents of the first magnetic particles, the second magnetic particles, and the third magnetic particles are within the above ranges, the melt viscosity of a resin composition containing the first magnetic particles, the second magnetic particles, and the third magnetic particles can be kept low.

The fluidity of magnetic particles in a resin composition produced by mixing a resin and the magnetic particles varies in accordance with the densities and particles sizes of the magnetic particles. Supposing that the densities of the first magnetic particles, the second magnetic particles, and the third magnetic particles are the same, the first magnetic particles, having the largest particle size, move in the resin composition most easily, and conversely, the third magnetic particles, having the smallest particle size, move in the resin composition least easily. Accordingly, due to the difference between the magnetic particles in ease of movement, the magnetic particles may be dispersed unevenly in a resin composition being cast into a mold. For example, the first magnetic particles may be concentrated in a region of the resin composition being cast into a mold. The viscosity of the resin composition is higher in a region having a high content of small-sized magnetic particles. Therefore, when the magnetic particles are dispersed unevenly in the resin composition, the viscosity of the resin composition is increased locally, and as a result, a high pressure is necessary to cast the resin composition.

In one embodiment of the present invention, the particle size distributions of the second magnetic particles and the third magnetic particles are set such that the particle size distribution of the third magnetic particles overlaps that of the second magnetic particles. For example, in one embodiment, the particle size distributions of the second magnetic particles and the third magnetic particles are set such that a particle size at a cumulative frequency 5% of the particle size distribution of the second magnetic particles is smaller than a particle size of which frequencies in particle size distribution of the third magnetic particles and the particle size distribution of the second magnetic particles are equal. In another embodiment, the particle size distributions of the second magnetic particles and the third magnetic particles are set such that a particle size at a cumulative frequency 10% of the particle size distribution of the second magnetic particles is smaller than a particle size at a cumulative frequency 90% of the particle size distribution of the third magnetic particles. As described above, when the particle size distribution of the third magnetic particles overlaps the particle size distribution of the second magnetic particles, the ease of movement of the third magnetic particles in the resin composition is closer to the ease of movement of the second magnetic particles, and therefore, the uneven dispersion of the magnetic particles in the resin composition can be moderated. As a result, the local increase of the viscosity of the resin composition can be restrained.

In one embodiment of the present invention, the particle size distribution of the first magnetic particles overlaps that of the second magnetic particles. Thus, the ease of movement of the second magnetic particles in the resin composition is closer to the ease of movement of the first magnetic particles, and therefore, the uneven dispersion of the magnetic particles in the resin composition can be moderated. As a result, the local increase of the viscosity of the resin composition can be further restrained.

In one embodiment of the present invention, the first magnetic particles, the second magnetic particles, and the third magnetic particles contain Fe. For example, the first magnetic particles contain 72 to 97 wt % Fe, the second magnetic particles contain 87 to 99.8 wt % Fe, and the third magnetic particles contain 50 to 93 wt % Fe. In one embodiment of the present invention, the second magnetic particles and the third magnetic particles contain 92 wt % or more Fe. According to these embodiments, the magnetic main body has an excellent magnetic permeability.

In one embodiment of the present invention, the density of the second magnetic particles is equal to or higher than that of the first magnetic particles. Thus, the ease of movement of the second magnetic particles in the resin composition is closer to the ease of movement of the first magnetic particles, and therefore, the uneven dispersion of the magnetic particles in the resin composition can be moderated. Accordingly, the local increase of the viscosity of the resin composition can be restrained.

In one embodiment of the present invention, the density of the third magnetic particles is equal to or higher than that of the second magnetic particles. Thus, the ease of movement of the third magnetic particles in the resin composition is closer to the ease of movement of the second magnetic particles, and therefore, the uneven dispersion of the magnetic particles in the resin composition can be moderated. Accordingly, the local increase of the viscosity of the resin composition can be restrained.

The third magnetic particles may be particles composed mainly of a material other than iron. Particles composed mainly of a material other than iron refer to particles having an iron content of less than 50%. Specific examples of particles composed mainly of a material other than iron include particles composed mainly of nickel and particles composed mainly of silica. When particles composed mainly of nickel are used as the third magnetic particles, the magnetic permeability of the magnetic main body can be higher. The density of the third magnetic particles, composed mainly of nickel, may be lower than that of the second magnetic particles.

In one embodiment of the present invention, the magnetic particles have a volume resistivity of $10^9$ Ω·cm or higher. Thus, the coil component can have larger direct current (DC) superposition characteristics, which makes the coil component more suited to circuits provided with a large electric current.

In one embodiment of the present invention, the magnetic particles further include fourth magnetic particles, the average particle size of the fourth magnetic particles is smaller than that of the third magnetic particles, and the particle size distribution of the fourth magnetic particles overlaps that of the third magnetic particles.

ADVANTAGES

According to one embodiment of the present invention, it is possible to increase the filling factor of magnetic particles and increase the evenness of distribution of the magnetic particles in a magnetic main body of a coil component.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear to an accurate scale, for convenience of description.

Figure 1:
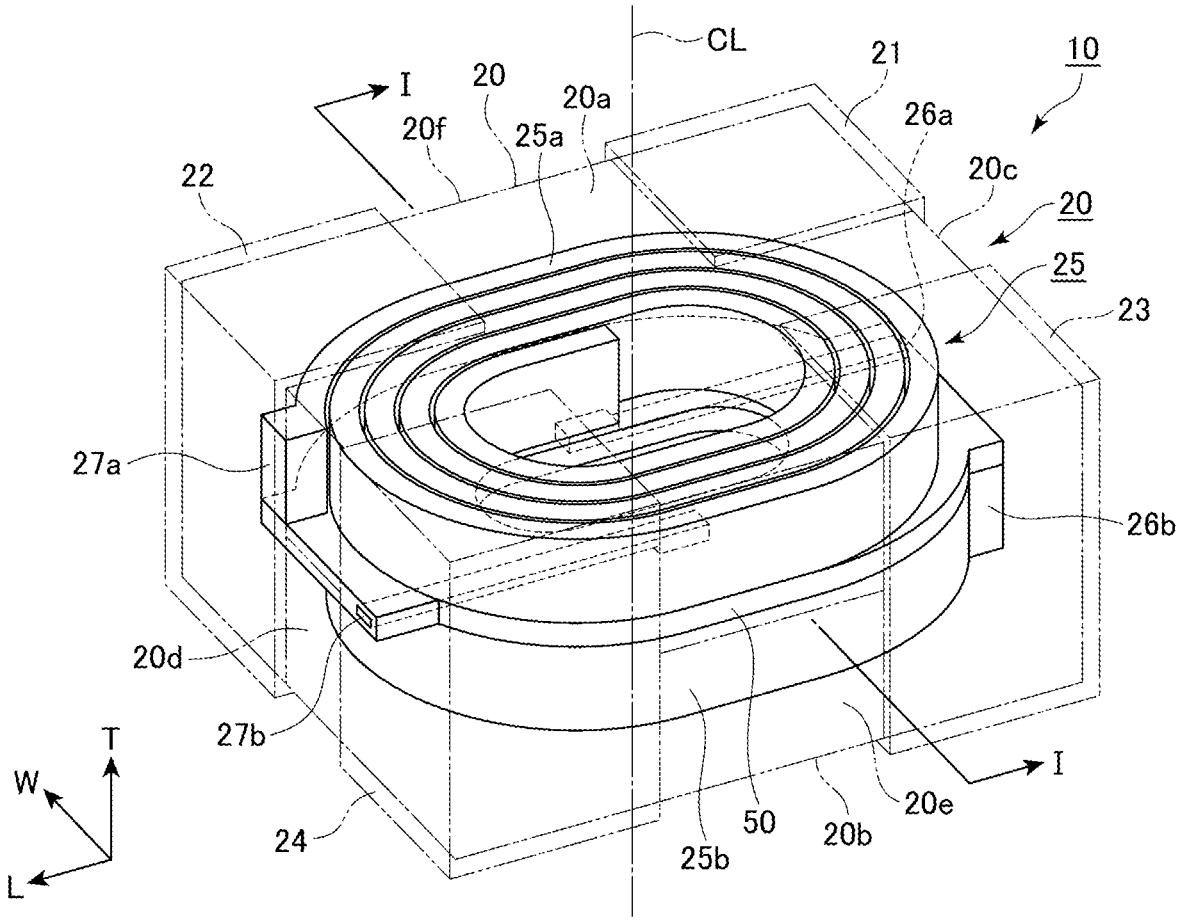
FIG. 1 is a perspective view of a coil component according to one embodiment of the present invention.
Figure 2A:
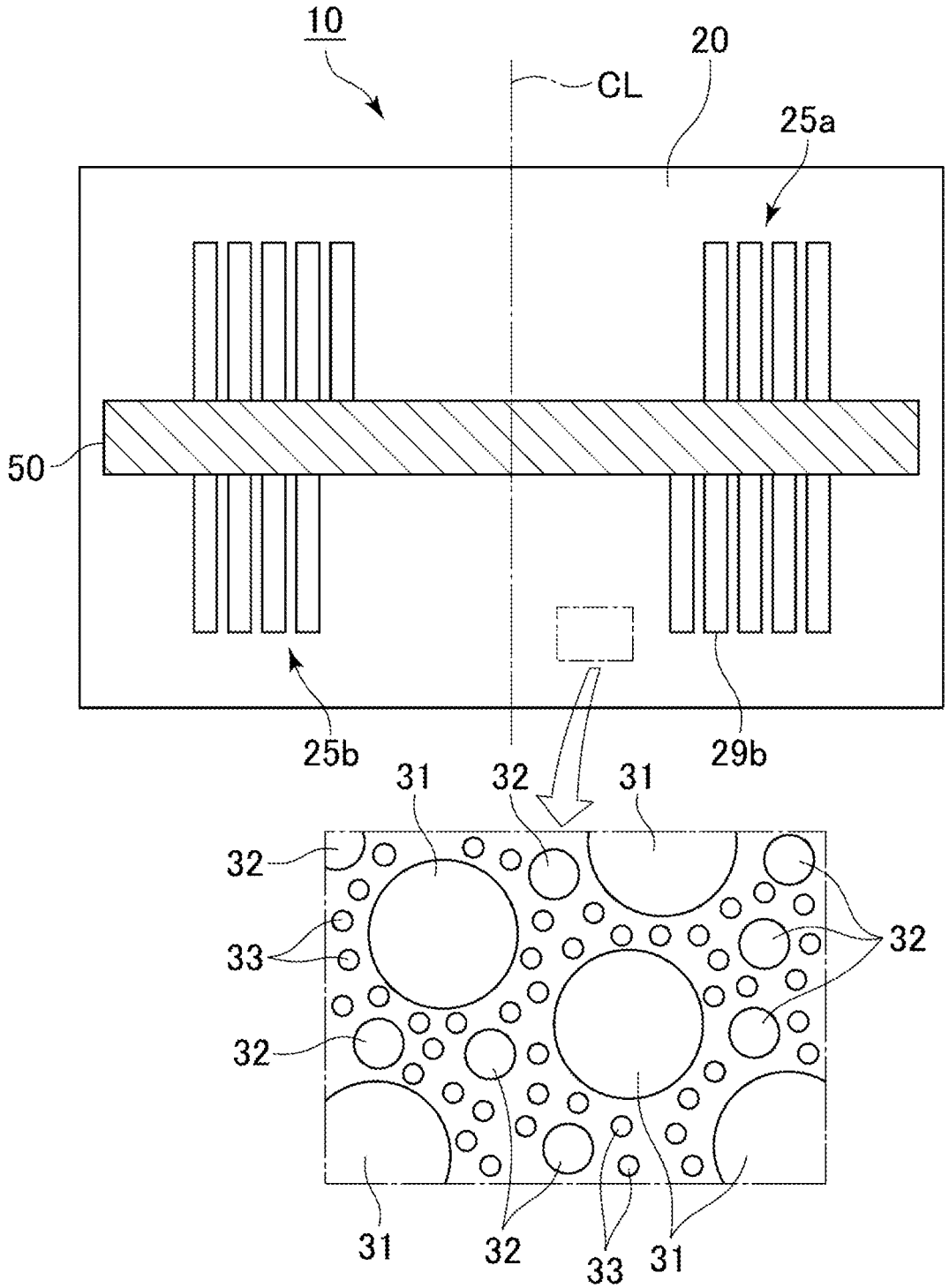
FIG. 2A schematically shows a cross section of the coil component of FIG. 1 cut along the line I-I.

A coil component 10 according to one embodiment of the present invention will be hereinafter described with reference to FIGS. 1 and 2A-2B. FIG. 1 is a perspective view of a coil component 10 according to one embodiment of the present invention, and FIG. 2A schematically shows a cross section of the coil component 10 cut along the line I-I in FIG. 1. In FIG. 1, a part of the elements of the coil component 10 are illustrated to be transparent to show the interior structure of the coil component 10.

These drawings show, as one example of the coil component 10, a common mode choke coil for eliminating common mode noise from a differential transmission circuit that transmits a differential signal. A common mode choke coil is one example of a magnetic coupling coil component to which the present invention is applicable. The present invention can also be applied to a transformer, a coupled inductor, and other various coil components, in addition to a common mode choke coil.

The coil component 10 can be produced by, for example, a thin film process. The coil component of the present invention can also be produced by any known processes other than a thin film process.

As shown, the coil component 10 according to one embodiment of the present invention includes a magnetic main boy 20, a coil conductor 25 embedded in the magnetic main boy 20, an insulating substrate 50, and four external electrodes 21 to 24. The coil conductor 25 includes a coil conductor 25*a* formed on the top surface of the insulating substrate 50 and a coil conductor 25*b* formed on the bottom surface of the insulating substrate 50.

The external electrode 21 is electrically connected to one end of the coil conductor 25*a*, and the external electrode 22 is electrically connected to the other end of the coil conductor 25*a*. The external electrode 23 is electrically connected to one end of the coil conductor 25*b*, and the external electrode 24 is electrically connected to the other end of the coil conductor 25*b*.

In this specification, the "length" direction, the "width" direction, and the "thickness" direction of the coil component 10 refer to the direction "L", the direction "W", and the direction "T" in FIG. 1, respectively, unless otherwise construed from the context. The top-bottom direction of the coil component 1 refers to the top-bottom direction in FIG. 1.

In one embodiment of the present invention, the coil component 10 has a length (the dimension in the direction L) of 1.0 to 2.6 mm, a width (the dimension in the direction W) of 0.5 to 2.1 mm, and a thickness (the dimension in the direction T) of 0.5 to 1.0 mm. As will be described later, according to the embodiments of the present invention, a resin composition used as a material of the magnetic main body 20 has a melt viscosity of 270 Pa·s or lower when it is placed into the mold, and therefore, the dimensions of the coil component can be small. For example, the thickness of the magnetic main body 20 of the coil component 10 is 0.95 mm or smaller.

The insulating substrate 50 is made from a magnetic material into a tabular shape. The magnetic material used for the insulating substrate 50 is, for example, a composite magnetic material containing a binder resin and filler particles. This binder resin is, for example, a thermosetting resin having an excellent insulation quality, examples of which include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin.

In one embodiment of the present invention, the filler particles used in the insulating substrate 50 are, for example, particles of a ferrite material, metal magnetic particles, particles of an inorganic material such as $SiO_2$ or $Al_2O_3$, glass-based particles, or any other known filler particles. Particles of a ferrite material applicable to the present invention are, for example, particles of Ni—Zn ferrite or particles of Ni—Zn—Cu ferrite. Metal magnetic particles applicable to the present invention are made of a material in which magnetism is developed in an unoxidized metal portion, and such metal magnetic particles are, for example, particles including unoxidized metal particles or alloy particles. Metal magnetic particles applicable to the present invention include particles of, for example, a Fe—Si—Cr, Fe—Si—Al, or Fe—Ni alloy, a Fe—Si—Cr—B—C or Fe—Si—B—Cr amorphous alloy, Fe, or a mixture thereof. Metal magnetic particles applicable to the present invention further include particles of Fe—Si—Al or Fe—Si—Al—Cr. Powder compacts made of these types of particles can also be used as the metal magnetic particles of the present invention. Moreover, these types of particles or powder compacts each having a surface thermally treated to form an oxidized film thereon can also be used as the metal magnetic particles of the present invention. The metal magnetic particles applicable to the present invention are manufactured by, for example, an atomizing method. Furthermore, the metal magnetic particles applicable to the present invention can be manufactured by a known method. Commercially available metal magnetic particles can also be used in the present invention. Examples of commercially available metal magnetic particles include PF-20F manufactured by Epson Atmix Corporation and SFR-FeSiAl manufactured by Nippon Atomized Metal Powders Corporation.

In one embodiment of the present invention, the insulating substrate 50 has a larger resistance value than the magnetic main body 20. Thus, even when the insulating substrate 50 has a small thickness, electric insulation between the coil conductor 25*a* and the coil conductor 25*b* can be ensured.

The coil conductor 25*a* is formed in a pattern on the top surface of the insulating substrate 50. In the embodiment shown, the coil conductor 25*a* includes a turning portion having a plurality of turns around the coil axis CL.

Likewise, the coil conductor 25*b* is formed in a pattern on the bottom surface of the insulating substrate 50. In the embodiment shown, the coil conductor 25*b* includes a turning portion having a plurality of turns around the coil axis CL. In one embodiment of the present invention, the top surface of the turning portion of the coil conductor 25*b* is opposed to the bottom surface of the turning portion of the coil conductor 25*a*.

The coil conductor 25*a* has a lead conductor 26*a* on one end thereof and a lead conductor 27*a* on the other end. The coil conductor 25*a* is electrically connected to the external electrode 21 via the lead conductor 26*a* and is electrically connected to the external electrode 22 via the lead conductor 27*a*. Likewise, the coil conductor 25*b* has a lead conductor 26*b* on one end thereof and a lead conductor 27*b* on the other end. The coil conductor 25*b* is electrically connected to the external electrode 23 via the lead conductor 26*b* and is electrically connected to the external electrode 24 via the lead conductor 27*b*.

The coil conductor 25*a* and the coil conductor 25*b* are formed by forming a patterned resist on the surface of the insulating substrate 50 and filling a conductive metal into an opening in the resist by plating.

In one embodiment of the present invention, the magnetic main body 20 has a first principal surface 20*a*, a second principal surface 20*b*, a first end surface 20*c*, a second end surface 20*d*, a first side surface 20*e*, and a second side surface 20*f*. The outer surface of the magnetic main body 20 is defined by these six surfaces.

The external electrode 21 and the external electrode 23 are provided on the first end surface 20*c* of the magnetic main body 20. The external electrode 22 and the external electrode 24 are provided on the second end surface 20*d* of the magnetic main body 20. As shown, these external electrodes extend onto the top surface 20*a* and the bottom surface 20*b* of the magnetic main body 20.

In one embodiment of the present invention, the magnetic main body 20 is made of a resin containing a large number of magnetic particles dispersed therein. In one embodiment of the present invention, the resin contained in the magnetic main body 20 is a thermosetting resin having an excellent insulating quality Examples of a thermosetting resin used to form the magnetic main body 20 include benzocyclobutene (BCB), an epoxy resin, a phenolic resin, an unsaturated polyester resin, a vinyl ester resin, a polyimide resin (PI), a polyphenylene ether (oxide) resin (PPO), a bismaleimide-triazine cyanate ester resin, a fumarate resin, a polybutadiene resin, and a polyvinyl benzyl ether resin.

The magnetic main body 20 contains a large number of magnetic particles. These magnetic particles include three types of magnetic particles having different particle sizes. As shown in FIG. 2A, in one embodiment of the present invention, the magnetic particles of the magnetic main body 20 include a plurality of first magnetic particles 31, a plurality of second magnetic particles 32, and a plurality of third magnetic particles 33. It should be noted that the magnetic particles shown in FIG. 2 do not appear to an accurate scale, so as to emphasize the difference in particle size.

Among the three types of magnetic particles, the first magnetic particles 31 have the largest average particle size. The average particle size of the first magnetic particles 31 is, for example, 15 μm to 50 μm.

The average particle size of the second magnetic particles 32 is smaller than that of the first magnetic particles 31, and the average particle size of the third magnetic particles 33 is smaller than that of the second magnetic particles 32. In one embodiment, the average particle size of the second magnetic particles 32 is 2 μm to 10 μm, and the average particle size of the third magnetic particles 33 is smaller than 2 μm.

Since the average particle size of the first magnetic particles 31 is larger than that of the second magnetic particles 32 and the average particle size of the second magnetic particles 32 is larger than that of the third magnetic particles 33, the first magnetic particles 31, the second magnetic particles 32, and the third magnetic particles 33 may be herein referred to as the large-sized particles, the middle-sized particles, and the small-sized particles, respectively.

The average particle size of the third magnetic particles 33 may be 0.5 μm or smaller. Thus, even when the coil component is excited at a high frequency, it can be prevented that an eddy current occurs in the third magnetic particles 33. As a result, the coil component 10 has excellent high frequency characteristics.

The term "average particle size" of magnetic particles herein refers to a volume-based average particles size, unless otherwise construed. The volume-based average particle size of the magnetic particles is measured by the laser diffraction scattering method in conformity to JIS Z 8825. An example of the devices for the laser diffraction scattering method is the laser diffraction/scattering particle size distribution measuring device LA-960 from HORIBA Ltd., at Kyoto city, Kyoto, Japan.

In one embodiment of the present invention, the proportion of the entire volume of the first magnetic particles 31 to the total volume of the first magnetic particles 31, the second magnetic particles 32, and the third magnetic particles 33 is 70 vol % to 85 vol %. The total volume of the first magnetic particles 31, the second magnetic particles 32, and the third magnetic particles 33 is the sum of the volumes of all the first magnetic particles 31, all the second magnetic particles 32, and all the third magnetic particles 33 contained in the magnetic main boy 20, and this may be herein referred to also as "the total magnetic particle volume." The term "volume percent" of a particular type of magnetic particles herein refers to the proportion of the entire volume of that particular type of the magnetic particles to the total volume (the total magnetic particle volume) of a plurality of types of magnetic particles contained in the magnetic main body 20 (or the resin composition used as a material of the magnetic main body 20). For example, when the magnetic main body 20 contains the first magnetic particles 31, the second magnetic particles 32, and the third magnetic particles 33, the proportion of the entire volume of the first magnetic particles 31 to the total magnetic particle volume is referred to as the volume percent of the first magnetic particles 31. The total volume of the first magnetic particles 31, the second magnetic particles 32, and the third magnetic particles 33 can be calculated by summing up the volumes of all the magnetic particles (the first magnetic particles 31, the second magnetic particles 32, and the third magnetic particles 33) appearing in a section cutting the magnetic main body 20. The three-dimensional shapes of the magnetic particles can be grasped through data processing based on data of a plurality of sections at different depth in the same location. The particle size of a magnetic particle can be estimated to be the diameter of a sphere approximated by the magnetic particle. The entire volume of the first magnetic particles 31 can be calculated by summing up the volumes of all the first magnetic particles 31 appearing in the section. Likewise, the entire volume of the second magnetic particles 32 can be calculated by summing up the volumes of all the second magnetic particles 32 appearing in the section, and the entire volume of the third magnetic particles 33 can be calculated by summing up the volumes of all the third magnetic particles 33 appearing in the section. The volumes of the magnetic particles appearing in the section cutting the magnetic main body 20 can be calculated by measuring the particle sizes of the magnetic particles appearing in the section by the above-mentioned laser diffraction scattering method in conformity to JIS Z 8825 and converting the measured particle sizes into volumes. In the conversion from the particle sizes to volumes, the magnetic particles are supposed to have a spherical shape in light of the measurement principle of the laser diffraction scattering method in conformity to JIS Z 8825.

In one embodiment of the present invention, the proportion of the entire volume of the second magnetic particles 32 to the total magnetic particle volume is 2 vol % to 28 vol %, and the proportion of the entire volume of the third magnetic particles 33 to the total magnetic particle volume is 2 vol % to 28 vol %.

As described above, three or more types of particles having different average particle sizes can be mixed together to increase the filling factor of the magnetic particles in the magnetic main body. In one embodiment of the present invention, the filling factor of the magnetic particles in the magnetic main body is 87% or higher. This increases the magnetic permeability of the magnetic main body.

In one embodiment of the present invention, the first magnetic particles 31, the second magnetic particles 32, and the third magnetic particles 33 are made of a Fe-based amorphous alloy containing iron (Fe). The Fe-based amorphous alloy is, for example, Fe—Si—Cr—B—C, Fe—Si—B—Cr, or a mixture thereof.

In one embodiment of the present invention, the first magnetic particles 31 contain 72 wt % to 80 wt % Fe, the second magnetic particles 32 contain 87 wt % to 99.8 wt % Fe, and the third magnetic particles 33 contain 50 wt % to 93 wt % Fe. The content of Fe in the second magnetic particles 32 and the third magnetic particles 33 may be 92 wt % or larger. This composition increases the magnetic permeability of the magnetic main body 20.

In one embodiment of the present invention, the density of the second magnetic particles 32 is equal to or higher than that of the first magnetic particles 31. For example, the content of Fe in the second magnetic particles 32 may be higher than that in the first magnetic particles 31 such that the density of the second magnetic particles 32 is higher than that of the first magnetic particles 31.

In one embodiment of the present invention, the density of the third magnetic particles 33 is equal to or higher than that of the second magnetic particles 32. For example, the content of Fe in the third magnetic particles 33 may be higher than that in the second magnetic particles 32 such that the density of the third magnetic particles 33 is higher than that of the second magnetic particles 32.

In one embodiment of the present invention, the first magnetic particles 31, the second magnetic particles 32, and the third magnetic particles 33 have a volume resistivity of $10^9$ Ω·cm or higher. Thus, the coil component 10 can have larger direct current (DC) superposition characteristics. As a result, the coil component 10 can be more suitable to circuits provided with a large electric current.

Figure 3:
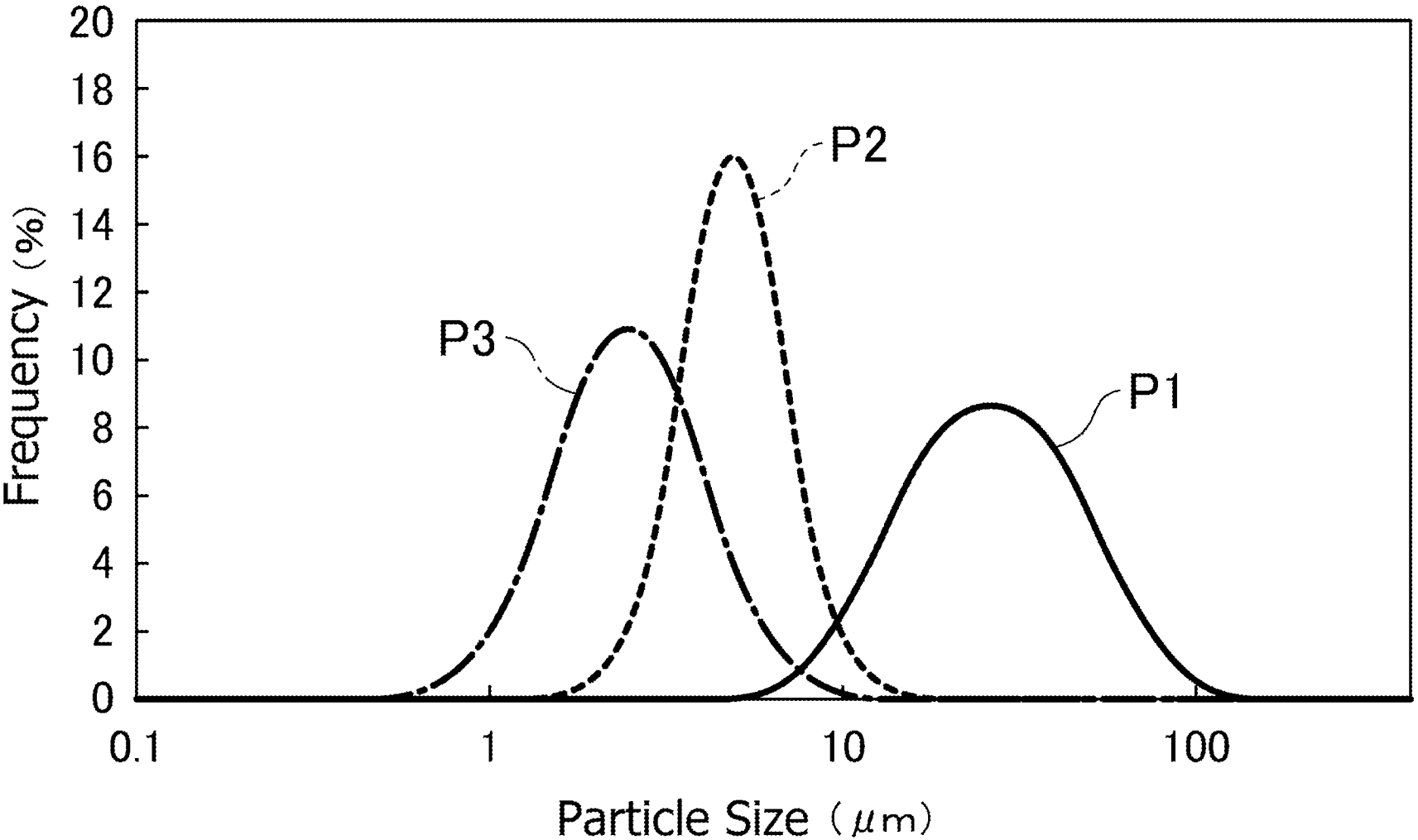
FIG. 3 is a graph showing a volume-based particle size distribution of magnetic particles contained in a magnetic main body of the coil component of FIG. 1.

FIG. 3 is a graph showing an example of a particle size distribution of the magnetic particles contained in the magnetic main body 20. As shown, this particle size distribution graph includes three peaks: the first peak P1, the second peak P2, and the third peak P3. The particle size distribution including the first peak P1 represents the particle size distribution of the first magnetic particles 31, the particle size distribution including the second peak P2 represents the particle size distribution of the second magnetic particles 32, and the particle size distribution including the third peak P3 represents the particle size distribution of the third magnetic particles 33.

The first peak P1 is located within the range from 15 μm to 50 μm, the second peak P2 is located within the range from 2 μm to 10 μm, and the third peak P3 is located within the range less than 2 μm. As described above, the magnetic main body 20 contains magnetic particles including the first magnetic particles 31, the second magnetic particles 32, and the third magnetic particles 33 mixed together at a predetermined ratio. FIG. 3 shows the particle size distributions of the three types of magnetic particles mixed together.

In one embodiment of the present invention, as shown in FIG. 3, the particle size distribution of the third magnetic particles 33 overlaps that of the second magnetic particles 32. For example, the 10 percent value of the particle size distribution of the second magnetic particles 32 is smaller than the 90 percent value of the particle size distribution of the third magnetic particles 33.

In one embodiment of the present invention, the particle size distribution of the second magnetic particles 32 may overlap that of the first magnetic particles 31. In this case, the 10 percent value of the particle size distribution of the first magnetic particles 31 is smaller than the 90 percent value of the particle size distribution of the second magnetic particles 32. The particle size distribution of the second magnetic particles 32 and the particle size distribution of the first magnetic particles 31 may not overlap each other.

Figure 2B:
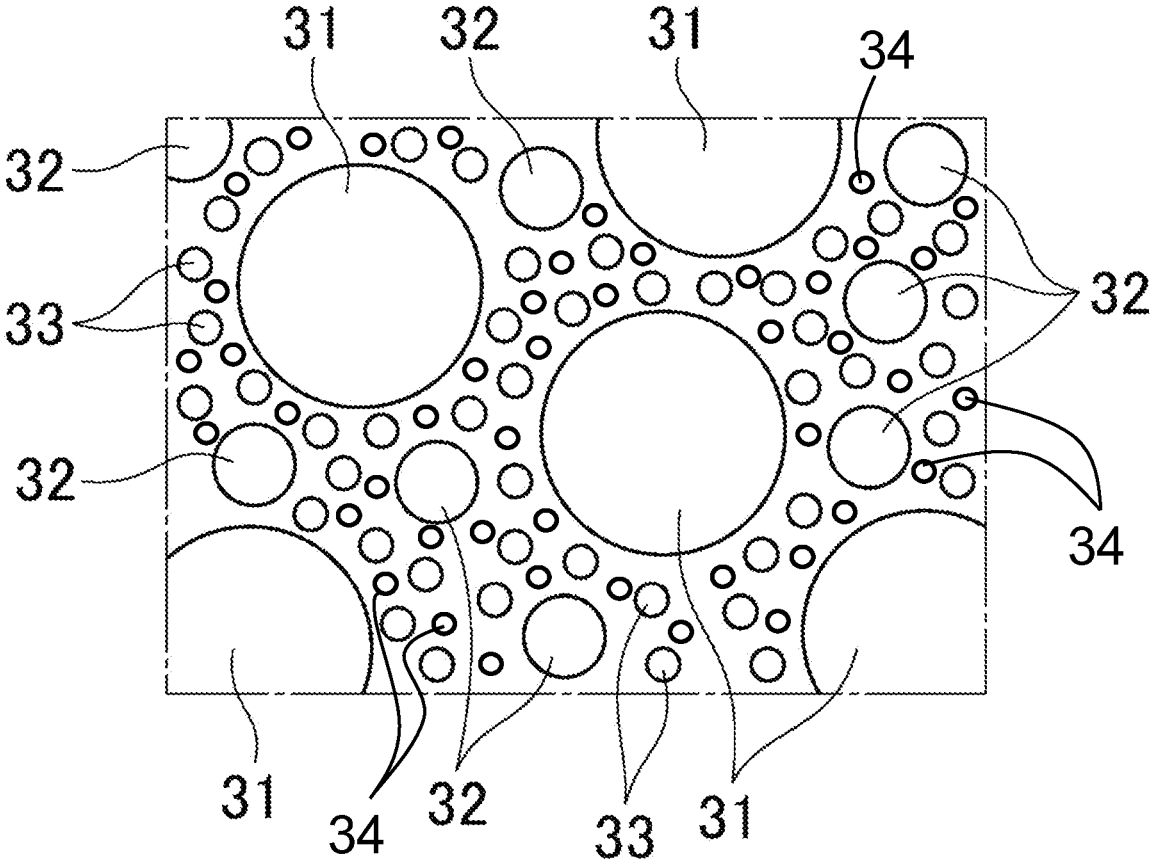
FIG. 2B schematically shows an alternate embodiment of a cross section of the coil component of FIG. 1 cut along the line I-I.

In one embodiment of the present invention, the magnetic main body 20 may contain four or more types of magnetic particles, shown in FIG. 2B. For example, the magnetic main body 20 may contain fourth magnetic particles 34 having a smaller average particle size than the third magnetic particles 33. In this case, the particle size distribution of the fourth magnetic particles 34 may overlap that of the third magnetic particles 33.

Next, a description is given of an example of a production method of the coil component 10. The coil component 10 can be produced by, for example, a thin film process. The first step of the thin film process for producing the coil component 10 is to prepare an insulating substrate made from a magnetic material into a tabular shape. This insulating substrate is configured, for example, in the same manner as the insulating substrate 50 described above.

Next, a photoresist is applied to the top surface and the bottom surface of the insulating substrate, and then conductive patterns are transferred onto the top surface and the bottom surface of the insulating substrate by exposure, and development is performed. As a result, a resist having an opening pattern for forming a coil conductor is formed on each of the top surface and the bottom surface of the insulating substrate. For example, the conductive pattern formed on the top surface of the insulating substrate corresponds to the coil conductor 25*a* described above, and the conductive pattern formed on the bottom surface of the insulating substrate corresponds to the coil conductor 25*b* described above.

Next, a conductive metal is filled into each of the opening patterns by plating. Next, the resists are removed from the insulating substrate by etching to form the coil conductors on the top surface and the bottom surface of the insulating substrate.

The next step is to form a magnetic main body on both surfaces of the insulating substrate having the coil conductors formed thereon. This magnetic main body corresponds to, for example, the magnetic main body 20 described above. This magnetic main body is produced by, for example, transfer molding. More specifically, the insulating substrate having the coil conductors formed thereon is placed in a mold, and a resin composition (a slurry) produced by mixing three types of magnetic particles and a thermosetting resin (e.g., an epoxy resin) is cast into the mold, thereby to produce a molded product including the insulating substrate and the magnetic main body formed thereon. These three types of magnetic particles are, for example, the first magnetic particles 31, the second magnetic particles 32, and the third magnetic particles 33 described above.

Next, a predetermined number of external electrodes are formed on the molded product including the insulating substrate and the magnetic main body formed thereon. These external electrodes correspond to, for example, the external electrodes 21 to 24 described above. Each of the external electrodes is formed by applying a conductive paste onto the surface of the magnetic main body to form a base electrode and forming a plating layer on the surface of the base electrode. The plating layer is constituted by, for example, two layers including a nickel plating layer containing nickel and a tin plating layer containing tin.

The coil component 10 according to one embodiment of the present invention is obtained through the above steps. The above-described method for producing the coil component 10 is merely one example, which does not limit methods for producing the coil component 10.

EXAMPLES

Next, examples of the present invention will now be described.

Three types of magnetic particles made of Fe—Si—Cr—B—C and having average particle sizes shown in Table 1 below were mixed with an epoxy resin to produce five samples of resin composition (Samples a1 to a5). In each of these five sample, the ratio of volume percents of large-sized particles having the largest average particle size, middle-sized particles having the second largest average particle size, and small-sized particles having the third largest (the smallest) average particle size was the large-sized particles: the middle-sized particles:the small-sized particles=75:17:8.

Each of Samples a1 to a5 was measured for melt viscosity. The melt viscosity was measured 20 seconds after placement of the samples using the flow tester CFT-500D from SHIMADZU CORPORATION, equipped with a die having a diameter 1 mm and a length 1 mm, under the condition of a test temperature 130° C. and a cylinder pressure 11,770,000 Pa.

The measured melt viscosities of the samples were as follows.

TABLE 1

| | | Average Particle Size (μm) | | | Melt |
|---|---|---|---|---|---|
| | | Large-sized Particles | Middle-sized Particles | Small-sized Particles | Viscosity [Pa · s] φ1.0 mm |
| Sample a1 | Comparative Example a1 | 55 | 11 | 4.4 | <270 Pa · s |
| Sample a2 | Example a1 | 50 | 10 | 4 | |
| Sample a3 | Example a2 | 25 | 5 | 2 | |
| Sample a4 | Example a3 | 15 | 3 | 1 | |
| Sample a5 | Comparative Example a2 | 12 | 2.4 | 0.96 | ≥270 Pa · s |

The melt viscosities of Samples a1 to a4 were less than 270 Pa·s. Thus, when the ratio of volume percents of the large-sized particles, the middle-sized particles, and the small-sized particles contained in a resin composition is 75:17:8 and the average particle size of the large-sized particles is from 15 μm to 50 μm, the resin composition has a melt viscosity as low as less than 270 Pa·s. The resin composition having a melt viscosity less than 270 Pa·s can be cast into a mold without a high pressure even when the minimum size of the cross section of the flow path passed by the resin composition is 0.2 mm or smaller.

Next, the following steps were performed to determine the effect of the content ratio of the large-sized particles, the middle-sized particles, and the small-sized particles in the resin composition on the melt viscosity. First, magnetic particles having an average particle size of 25 μm (large-sized particles), magnetic particles having an average particle size of 5 μm (middle-sized particles), and magnetic particles having an average particle size of 2 μm (small-sized particles) were mixed together at the ratios of volume percents shown in Table 2 below, and the mixed particles were mixed with an epoxy resin to produce 13 samples (Samples b1 to b13) of resin composition shown in Table 2. All these magnetic particles were formed of a Fe-based amorphous alloy expressed by Fe—Si—Cr—B—C.

Each of Samples b1 to b13 was measured for melt viscosity. The melt viscosity was measured 20 seconds after placement of the samples using the flow tester CFT-SOOD from SHIMADZU CORPORATION, equipped with a die having a diameter 1 mm and a length 1 mm, under the condition of a test temperature 130° C. and a cylinder pressure 11,770,000 Pa.

The measured melt viscosities of the samples were as follows.

TABLE 2

| | | Mixture Ratio of Magnetic Particles (Volume Percent) | | | Melt |
|---|---|---|---|---|---|
| | | Large-sized Particles (avg: 25 μm) | Middle-sized Particles (avg: 5 μm) | Small-sized Particles (avg: 1.9 μm) | Viscosity [Pa · s] ϕ1.0 mm |
| Sample b1 | Example b1 | 85 | 13 | 2 | 258 |
| Sample b2 | Example b2 | 85 | 2 | 13 | 251 |
| Sample b3 | Example b3 | 80 | 17 | 3 | 251 |
| Sample b4 | Example b4 | 80 | 12 | 8 | 249 |
| Sample b5 | Example b5 | 75 | 17 | 8 | 242 |
| Sample b6 | Example b6 | 75 | 8 | 17 | 246 |
| Sample b7 | Example b7 | 70 | 28 | 2 | 265 |
| Sample b8 | Example b8 | 70 | 2 | 28 | 261 |
| Sample b9 | Comparative Example b1 | 90 | 9 | 1 | 338 |
| Sample b10 | Comparative Example b2 | 80 | 20 | 0 | 274 |
| Sample b11 | Comparative Example b3 | 70 | 30 | 0 | 294 |
| Sample b12 | Comparative Example b4 | 65 | 2 | 33 | 280 |
| Sample b13 | Comparative Example b5 | 65 | 33 | 2 | 303 |

As shown in Table 2, Samples b1 to b8 had a melt viscosity less than 270 Pa·s, and Samples b9 to b13 had a melt viscosity of 270 Pa·s or higher.

Figure 4:
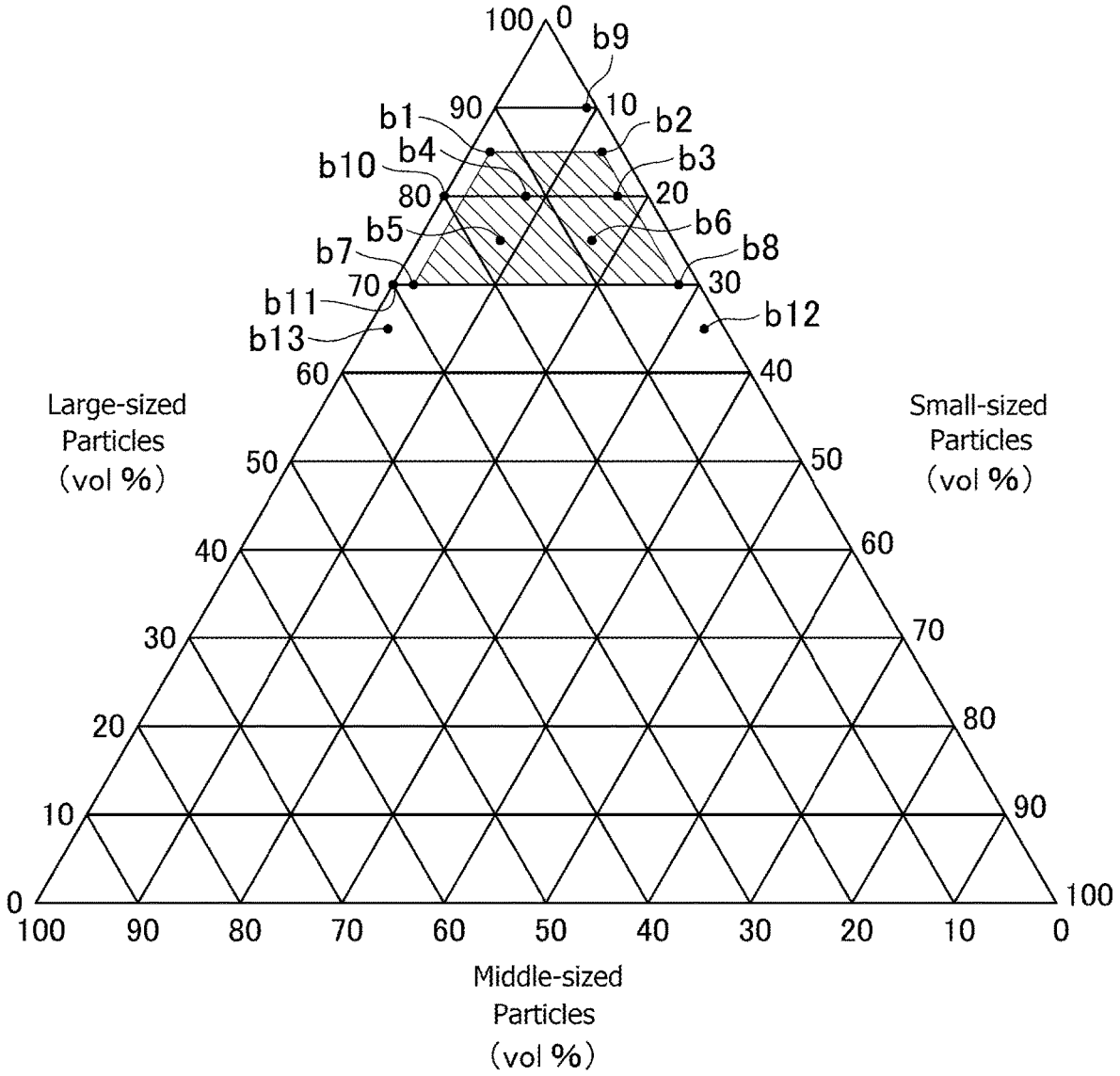
FIG. 4 is a triangular diagram showing volume percents of large-sized particles, middle-sized particles, and small-sized particles.

FIG. 4 is a triangular diagram showing volume percents of large-sized particles (first magnetic particles), middle-sized particles (second magnetic particles), and small-sized particles (third magnetic particles) in Samples b1 to b13. As shown in FIG. 4, in which Samples b1 to b13 are plotted in the triangular diagram, the melt viscosity of a resin composition containing three types of particles (the large-sized particles, the middle-sized particles, and the small-sized particles) having different average particle sizes is less than 270 Pa·s when the volume percent of the large-sized particles is 70% to 85%, the volume percent of the middle-sized particles is 2% to 28%, and the volume percent of the small-sized particles is 2% to 28% (corresponding to the hatched region in the triangular diagram of FIG. 4). When the average particle size of the large-sized particles is 15 μm to 50 μm, the ranges of the volume percents where the melt viscosity less than 270 Pa·s is obtained remain unchanged even if the average particle sizes of the large-sized particles, the middle-sized particles, and the small-sized particles are different from those shown in Table 2. More specifically, when the average particle size of the large-sized particles is 15 μm to 50 μm, the melt viscosity of the resin composition produced by mixing the resin and the three types of magnetic particles (the large-sized particles, the middle-sized particles, and the small-sized particles) is less than 270 Pa·s, subject to the volume percent of the large-sized particles being 70% to 85%, the volume percent of the middle-sized particles being 2% to 28%, and the volume percent of the small-sized particles being 2% to 28%, not subject to the average particle sizes of the large-sized particles, the middle-sized particles, and the small-sized particles.

Next, the following steps were performed to determine the effect of the content ratio of the large-sized particles, the middle-sized particles, and the small-sized particles in the resin composition on the melt viscosity. First, magnetic particles having an average particle size of 25 μm (large-sized particles), magnetic particles having an average particle size of 5 μm (middle-sized particles), and magnetic particles having an average particle size of 2 μm (small-sized particles) were mixed together at a ratio of volume percents of 75:17:8, and the mixed particles were mixed with an epoxy resin to produce six samples (Samples c1 to c6) of resin composition. All these magnetic particles were formed of a Fe-based amorphous alloy expressed by Fe—Si—Cr—B—C.

Figure 5:
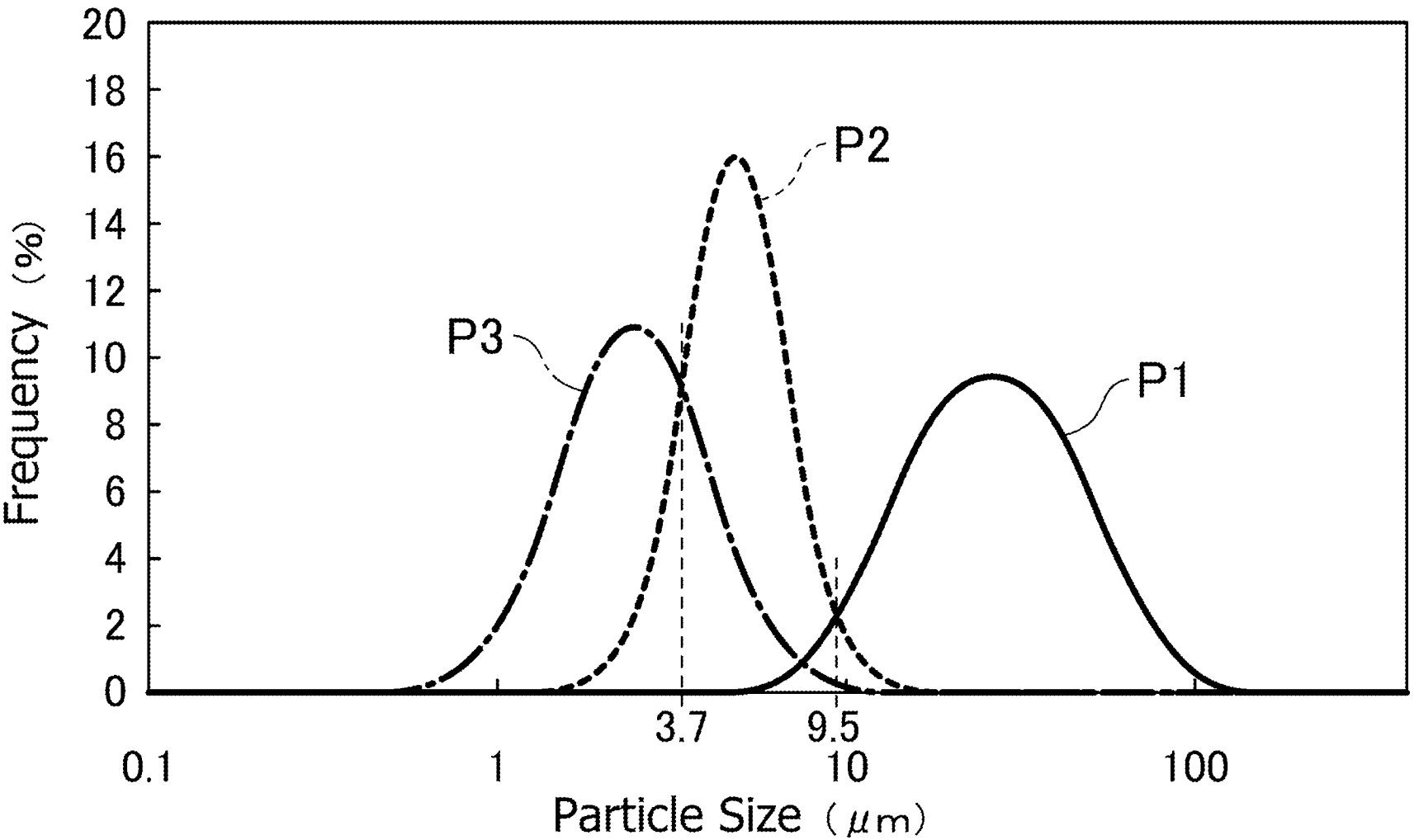
FIG. 5 is a graph showing a volume-based particle size distribution of magnetic particles contained in Sample c1 (Example c1).

In Samples c1 to c6, the particle size distributions of the magnetic particles overlap each other to different degrees, as shown in FIGS. 5 to 10. FIG. 5 is a graph showing a particle size distribution of magnetic particles contained in Sample c1. Sample c1 is a resin composition produced by mixing the large-sized particles, the middle-sized particles, and the small-sized particles having the particle size distributions shown in FIG. 5 with an epoxy resin as described above.

Figure 6:
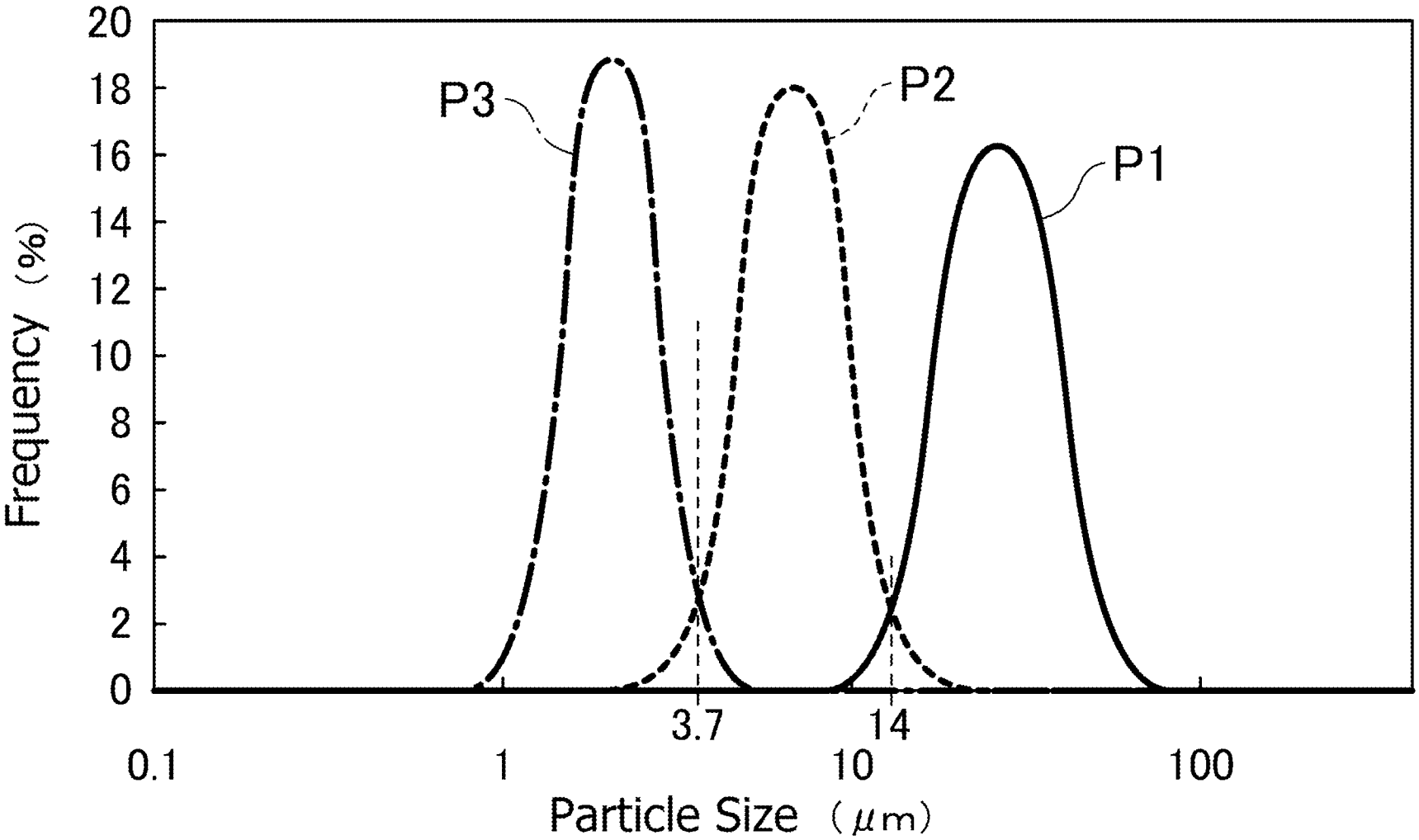
FIG. 6 is a graph showing a volume-based particle size distribution of magnetic particles contained in Sample c2 (Example c2).

Likewise, FIG. 6 is a graph showing a volume-based particle size distribution of magnetic particles contained in Sample c2. Sample c2 is a resin composition produced by mixing the large-sized particles, the middle-sized particles, and the small-sized particles having the particle size distributions shown in FIG. 6 with an epoxy resin as described above.

Figure 7:
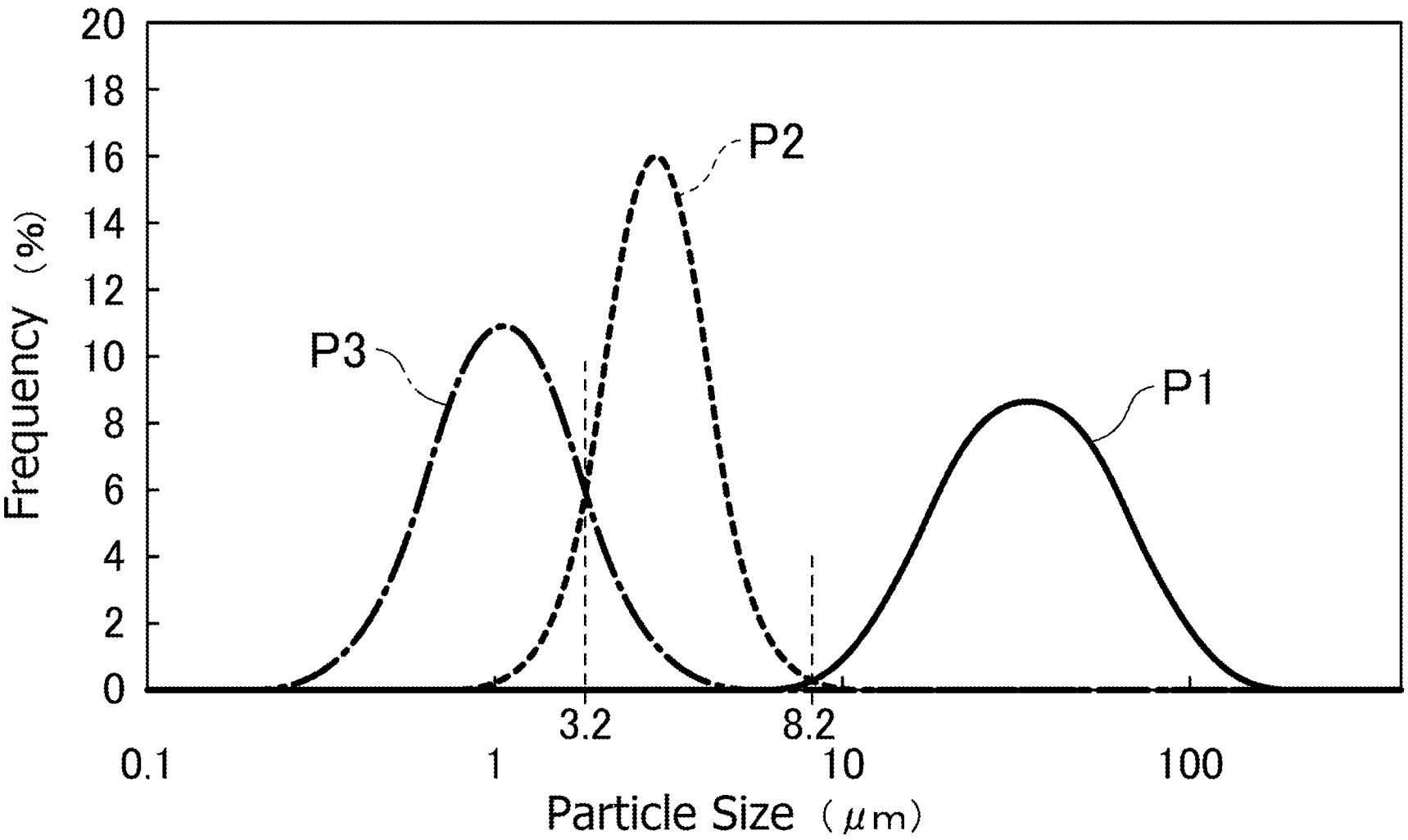
FIG. 7 is a graph showing a volume-based particle size distribution of magnetic particles contained in Sample c3 (Example c3).

FIG. 7 is a graph showing a volume-based particle size distribution of magnetic particles contained in Sample c3. Sample c3 is a resin composition produced by mixing the large-sized particles, the middle-sized particles, and the small-sized particles having the particle size distributions shown in FIG. 7 with an epoxy resin as described above.

Figure 8:
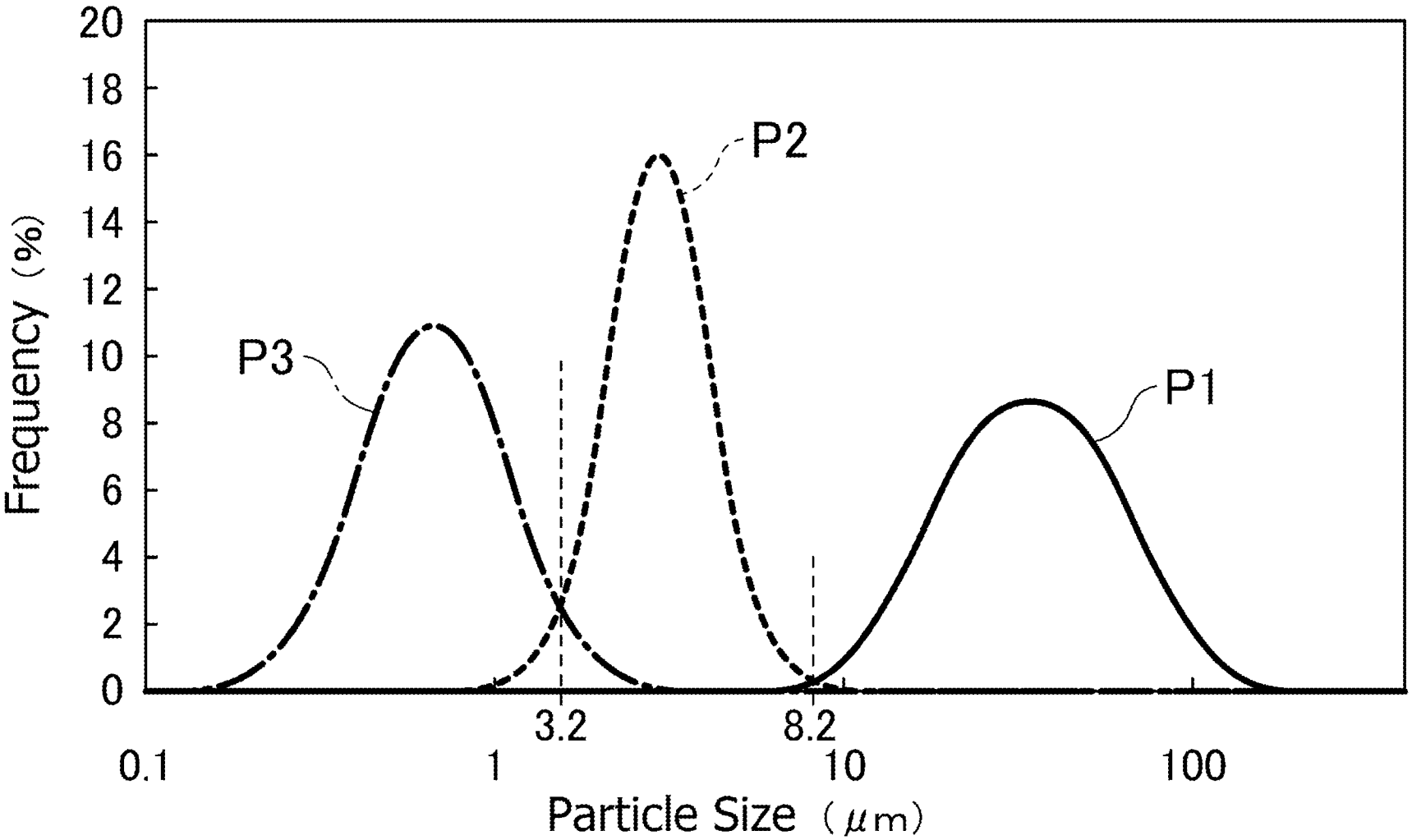
FIG. 8 is a graph showing a volume-based particle size distribution of magnetic particles contained in Sample c4 (Example c4).

FIG. 8 is a graph showing a volume-based particle size distribution of magnetic particles contained in Sample c4. Sample c4 is a resin composition produced by mixing the large-sized particles, the middle-sized particles, and the small-sized particles having the particle size distributions shown in FIG. 8 with an epoxy resin as described above.

Figure 9:
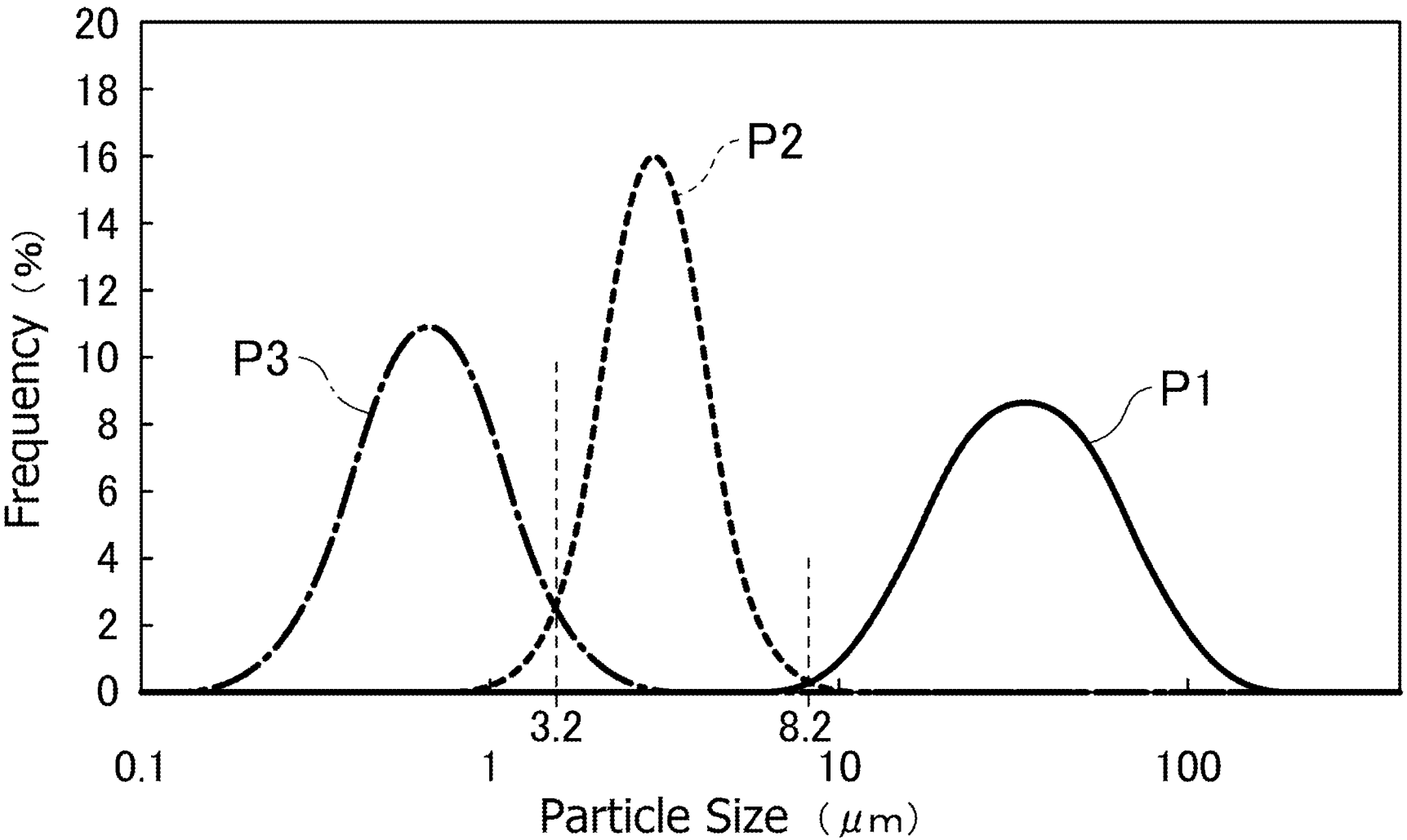
FIG. 9 is a graph showing a volume-based particle size distribution of magnetic particles contained in Sample c5 (Example c5).

FIG. 9 is a graph showing a volume-based particle size distribution of magnetic particles contained in Sample c5. Sample c5 is a resin composition produced by mixing the large-sized particles, the middle-sized particles, and the small-sized particles having the particle size distributions shown in FIG. 9 with an epoxy resin as described above.

Figure 10:
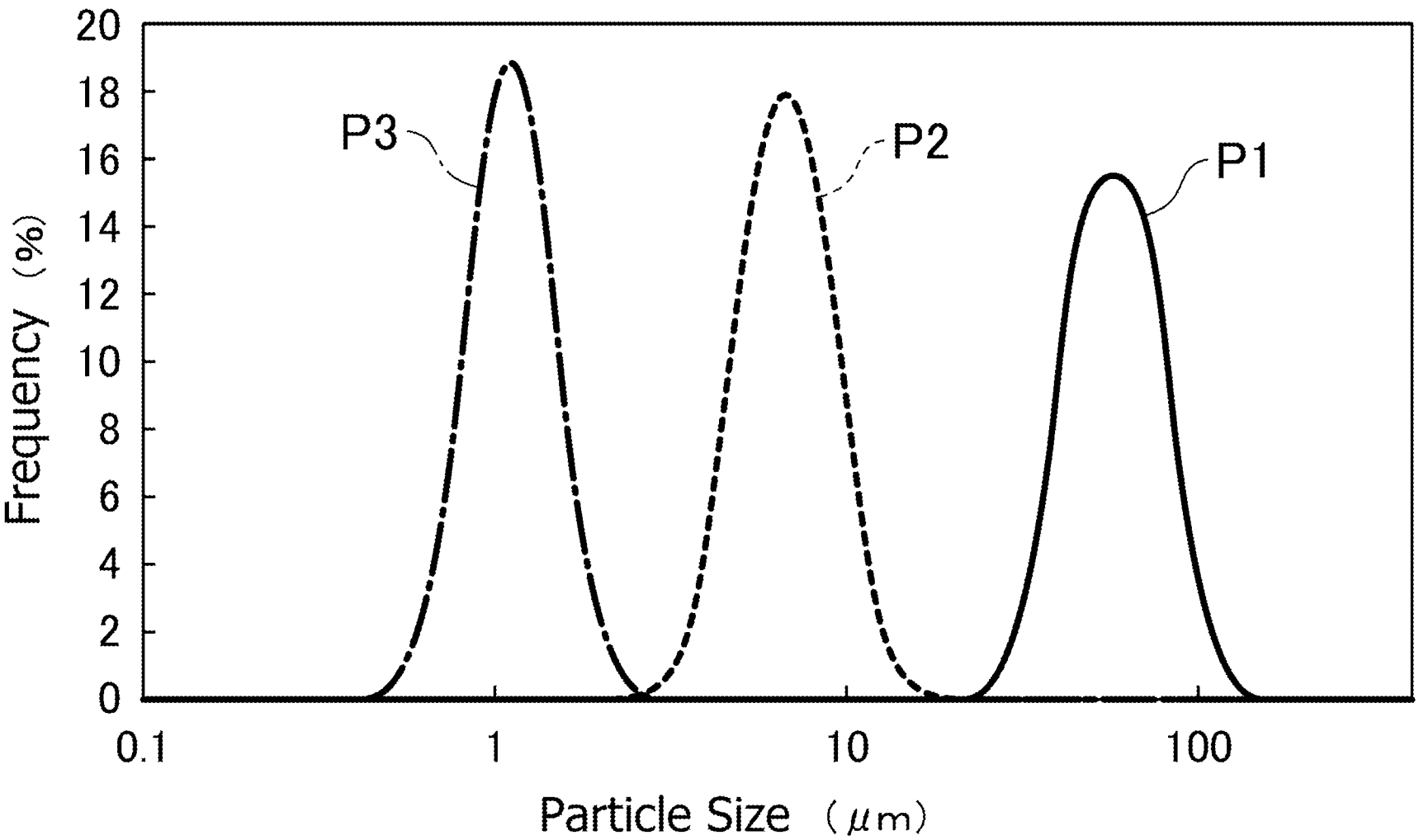
FIG. 10 is a graph showing a volume-based particle size distribution of magnetic particles contained in Sample c6 (Comparative Example c1).

FIG. 10 is a graph showing a volume-based particle size distribution of magnetic particles contained in Sample c6. Sample c6 is a resin composition produced by mixing the large-sized particles, the middle-sized particles, and the small-sized particles having the particle size distributions shown in FIG. 10 with an epoxy resin as described above.

Each of the graphs shown in FIGS. 5 to 10 has three peaks. In these drawings, the particle size distribution including the first peak P1 is the particle size distribution of the large-sized particles, the particle size distribution including the second peak P2 is the particle size distribution of the middle-sized particles, and the particle size distribution including the third peak P3 is the particle size distribution of the small-sized particles.

In Samples c1 to c5 shown in FIGS. 5 to 9, the particle size distribution of the large-sized particles overlap the particle size distribution of the middle-sized particles, and the particle size distribution of the middle-sized particles overlap the particle size distribution of the small-sized particles.

More specifically, in Sample c1 shown in FIG. 5, the graph of particle size distribution of the middle-sized particles intersects the graph of particle size distribution of the large-sized particles at the particle size of 9.5 μm, which corresponds to a cumulative frequency 95% of the particle size distribution of the middle-sized particles and a cumulative frequency 5% of the particle size distribution of the large-sized particles, and the graph of particle size distribution of the small-sized particles intersects the graph of particle size distribution of the middle-sized particles at the particle size of 3.7 μm, which corresponds to a cumulative frequency 80% of the particle size distribution of the small-sized particles and a cumulative frequency 20% of the particle size distribution of the middle-sized particles.

In Sample c2 shown in FIG. 6, the graph of particle size distribution of the middle-sized particles intersects the graph of particle size distribution of the large-sized particles at the particle size of 14 μm, which corresponds to a cumulative frequency 98% of the particle size distribution of the middle-sized particles and a cumulative frequency 2% of the particle size distribution of the large-sized particles, and the graph of particle size distribution of the small-sized particles intersects the graph of particle size distribution of the middle-sized particles at the particle size of 3.7 μm, which corresponds to a cumulative frequency 98% of the particle size distribution of the small-sized particles and a cumulative frequency 3% of the particle size distribution of the middle-sized particles.

In Sample c2 shown in FIG. 7, the graph of particle size distribution of the middle-sized particles intersects the graph of particle size distribution of the large-sized particles at the particle size of 8.2 μm, which corresponds to a cumulative frequency 99% of the particle size distribution of the middle-sized particles and a cumulative frequency 1% of the particle size distribution of the large-sized particles, and the graph of particle size distribution of the small-sized particles intersects the graph of particle size distribution of the middle-sized particles at the particle size of 3.2 μm, which corresponds to a cumulative frequency 87% of the particle size distribution of the small-sized particles and a cumulative frequency 14% of the particle size distribution of the middle-sized particles.

In Sample c4 shown in FIG. 8, the graph of particle size distribution of the middle-sized particles intersects the graph of particle size distribution of the large-sized particles at the particle size of 8.2 μm, which corresponds to a cumulative frequency 99% of the particle size distribution of the middle-sized particles and a cumulative frequency 1% of the particle size distribution of the large-sized particles, and the graph of particle size distribution of the small-sized particles intersects the graph of particle size distribution of the middle-sized particles at the particle size of 3.2 μm, which corresponds to a cumulative frequency 94% of the particle size distribution of the small-sized particles and a cumulative frequency 7% of the particle size distribution of the middle-sized particles.

In Sample c5 shown in FIG. 9, the graph of particle size distribution of the middle-sized particles intersects the graph of particle size distribution of the large-sized particles at the particle size of 8.2 μm, which corresponds to a cumulative frequency 99% of the particle size distribution of the middle-sized particles and a cumulative frequency 1% of the particle size distribution of the large-sized particles, and the graph of particle size distribution of the small-sized particles intersects the graph of particle size distribution of the middle-sized particles at the particle size of 3.2 μm, which corresponds to a cumulative frequency 96% of the particle size distribution of the small-sized particles and a cumulative frequency 3% of the particle size distribution of the middle-sized particles.

In Sample c6 shown in FIG. 10, the particle size distribution of the large-sized particles does not overlap the particle size distribution of the middle-sized particles, and the particle size distribution of the middle-sized particles does not overlap the particle size distribution of the small-sized particles.

Each of Samples c1 to c6 was measured for melt viscosity. The melt viscosity was measured 20 seconds after placement of the samples using the flow tester CFT-SOOD from SHIMADZU CORPORATION, equipped with a die having a diameter 1 mm and a length 1 mm, under the condition of a test temperature 130° C. and a cylinder pressure 11,770,000 Pa.

The measured melt viscosities of the samples were as follows.

TABLE 3

| | | Melt Viscosity [Pa · s] ϕ1.0 mm |
|---|---|---|
| Sample c1 | Example c1 | 233 |
| Sample c2 | Example c2 | 242 |
| Sample c3 | Example c3 | 254 |
| Sample c4 | Example c4 | 258 |
| Sample c5 | Example c5 | 262 |
| Sample c6 | Comparative Example c1 | 277 |

As shown in Table 3, Samples c1 to c5, in which particle size distributions of the magnetic particles overlap each other, had a melt viscosity less than 270 Pa·s, and Sample c6, in which particle size distributions of the magnetic particles do not overlap each other, had a melt viscosity of 270 Pa·s or higher. This confirmed that the melt viscosity of a resin composition is lower when the particle size distributions of the magnetic particles contained in the resin composition overlap each other than when the particle size distributions of the magnetic particles do not overlap each other.

The dimensions, materials, and arrangements of the various constituents described in this specification are not limited to those explicitly described for the embodiments, and the various constituents can be modified to have any dimensions, materials, and arrangements within the scope of the present invention. The constituents other than those explicitly described herein can be added to the described embodiments; and part of the constituents described for the embodiments can be omitted.

What is claimed is:

1. A coil component, comprising:

a magnetic main body containing a resin and magnetic particles; and a coil conductor embedded in the magnetic main body, wherein the magnetic particles include first magnetic particles, second magnetic particles, and third magnetic particles, an average particle size of the first magnetic particles is 15 μm to 50 μm, an average particle size of the second magnetic particles is smaller than that of the first magnetic particles, an average particle size of the third magnetic particles is smaller than that of the second magnetic particles, a volume percent of the first magnetic particles relative to a total volume of the first magnetic particles, the second magnetic particles, and the third magnetic particles is 70% to 85%, a volume percent of the second magnetic particles relative to the total volume is 2% to 28%, a volume percent of the third magnetic particles relative to the total volume is 2% to 28%, and a particle size distribution of the third magnetic particles overlaps that of the second magnetic particles, wherein a particle size at a cumulative frequency 5% of the particle size distribution of the second magnetic particles is smaller than a particle size of which frequencies in particle size distribution of the third magnetic particles and the particle size distribution of the second magnetic particles are equal.

2. The coil component of claim 1, wherein a particle size distribution of the first magnetic particles overlaps that of the second magnetic particles.

3. The coil component of claim 1, wherein a particle size at a cumulative frequency 10% of the particle size distribution of the second magnetic particles is smaller than a particle size at a cumulative frequency 90% of the particle size distribution of the third magnetic particles.

4. The coil component of claim 1, wherein an average particle size of the second magnetic particles is 2 μm to 10 μm.

5. The coil component of claim 1, wherein an average particle size of the third magnetic particles is less than 2 μm.

6. The coil component of claim 5, wherein the average particle size of the third magnetic particles is 0.5 μm or less.

7. The coil component of claim 1, wherein the first magnetic particles, the second magnetic particles, and the third magnetic particles contain Fe.

8. The coil component of claim 7, wherein the first magnetic particles contain 72 to 97 wt % Fe, the second magnetic particles contain 87 to 99.8 wt % Fe, and the third magnetic particles contain 50 to 93 wt % Fe.

9. The coil component of claim 7, wherein the second magnetic particles and the third magnetic particles contain 92 wt % or more Fe.

10. The coil component of claim 1, wherein a density of the second magnetic particles is equal to or greater than that of the first magnetic particles.

11. The coil component of claim 1, wherein a density of the third magnetic particles is equal to or greater than that of the second magnetic particles.

12. The coil component of claim 1, wherein a filling factor of all of the first, second, and third magnetic particles in the magnetic main body is 87% or higher.

13. The coil component of claim 1, wherein the magnetic particles have a volume resistivity of $10^9$ Ω·cm or higher.

* * * * *